US007681489B2

(12) United States Patent
Wu

(10) Patent No.: US 7,681,489 B2
(45) Date of Patent: Mar. 23, 2010

(54) EXTENDABLE PIPE UNIT FOR FRAME FLOOR PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 420 days.

(21) Appl. No.: 11/782,876

(22) Filed: Jul. 25, 2007

(65) Prior Publication Data

US 2008/0181799 A1 Jul. 31, 2008

(30) Foreign Application Priority Data

Jan. 31, 2007 (TW) ..... 96103554 A

(51) Int. Cl.
*F01B 31/00* (2006.01)
*F04B 53/00* (2006.01)

(52) U.S. Cl. ..... 92/58.1; 417/234

(58) Field of Classification Search ..... 92/58.1; 417/234, 572

See application file for complete search history.

(56) References Cited

U.S. PATENT DOCUMENTS 670,811 A * 3/1901 Phelps ..... 92/58.1
1,240,855 A * 9/1917 Jones ..... 92/58.1
1,356,160 A * 10/1920 Lawley ..... 92/58.1
5,551,848 A * 9/1996 Chuang et al. ..... 92/58.1
6,017,201 A * 1/2000 Yang ..... 417/572
7,040,355 B2 5/2006 Wu ..... 141/38

OTHER PUBLICATIONS

Taiwan Patent No. M278776 (4pp.).
German Utility Model Publication No. DE 9416836 U1, Dec. 15, 1994, 6 pages.
German Utility Model Publication No. DE 202004007623 U1, Sep. 16, 2004, 9 pages.

* cited by examiner

*Primary Examiner*—Michael Leslie
(74) *Attorney, Agent, or Firm*—Alan Kamrath; Kamrath & Associates PA

(57) ABSTRACT

A frame floor pump includes a cylinder having a first end and a second end opposite to the first end, an extendable pump unit having an outer pipe with a first end installed to a side of the second end of the cylinder and a second end, an inner hose disposed through the second end of the outer pipe and received in the outer pipe and a nozzle provided to couple to an end of the inner hose against the second end of the outer pipe; wherein the inner hose of the extendable pipe unit could extend to various lengths from the outer pipe of the extendable pipe unit while operating the frame floor pump; while the frame floor pump is collapsed and not used, the inner hose could be received in the outer pipe so as to be easy to stow.

11 Claims, 7 Drawing Sheets

EXTENDABLE PIPE UNIT FOR FRAME FLOOR PUMP

BACKGROUND OF THE INVENTION

1. Field of the Invention

The present invention relates to a pipe unit for a frame floor pump. In particular, the present invention relates to an extendable pipe unit for frame floor pumps.

2. Description of the Related Art

The conventional bicycle pump generally comprises three kinds, floor pump, mini pump and frame floor pump. The floor pump is too big and not easy to carry; the mini pump is effortless to carry but there is no hold to apply force easily while inflating; however, the frame floor pump is easy to stow and has a hold to force.

Referring to Taiwan Patent No. M278776, illustrating a frame floor pump 10 including a cylinder 11 having a first end and a second end, a pipe 13 installed to a side of the second end of the cylinder 11, a nozzle 14 connecting to the pipe 13opposite to the cylinder 11, a collapsible pedal 15 disposed on another side of the second end of the cylinder hand a collapsible handle 16 installed to the first end of the cylinder 11. The collapsible pedal 15 and the handle 16 are easy for stowing. And the pedal 15 allows a user stepping thereon to force to inflate easily. However, while operating the frame floor pump 10, because the length of the pipe 13 is about the same to the length of the cylinder 11, the user needs to take the pump close to a tire of bike so that the distance between the pump and the bike would be not enough to inflate quickly.

SUMMARY OF THE INVENTION

The present invention solves this need and other problems in the field of extendable pipe unit for frame floor pump by providing, a frame floor pump including a cylinder, an extendable pump unit installed pivotally to an end of the cylinder and having an outer pipe, an inner hose received in the outer pipe and a nozzle disposed on the outer pipe and insert into the inner hose. The outer pipe has a first end connecting to the end of the cylinder and a second end providing the inner hose disposed therethrough.

The inner hose of the extendable pipe unit could extend to various lengths from the outer pipe of the extendable pipe unit according as the desire of a user while operating the frame floor pump. And while the frame floor pump is collapsed and not used, the inner hose could be received in the outer pipe so as to be easy to stow.

Other advantages, objectives and features of the present invention will become apparent from the following description referring to the attached drawings.

DETAILED DESCRIPTION OF THE PREFERRED EMBODIMENT

Figure 1:
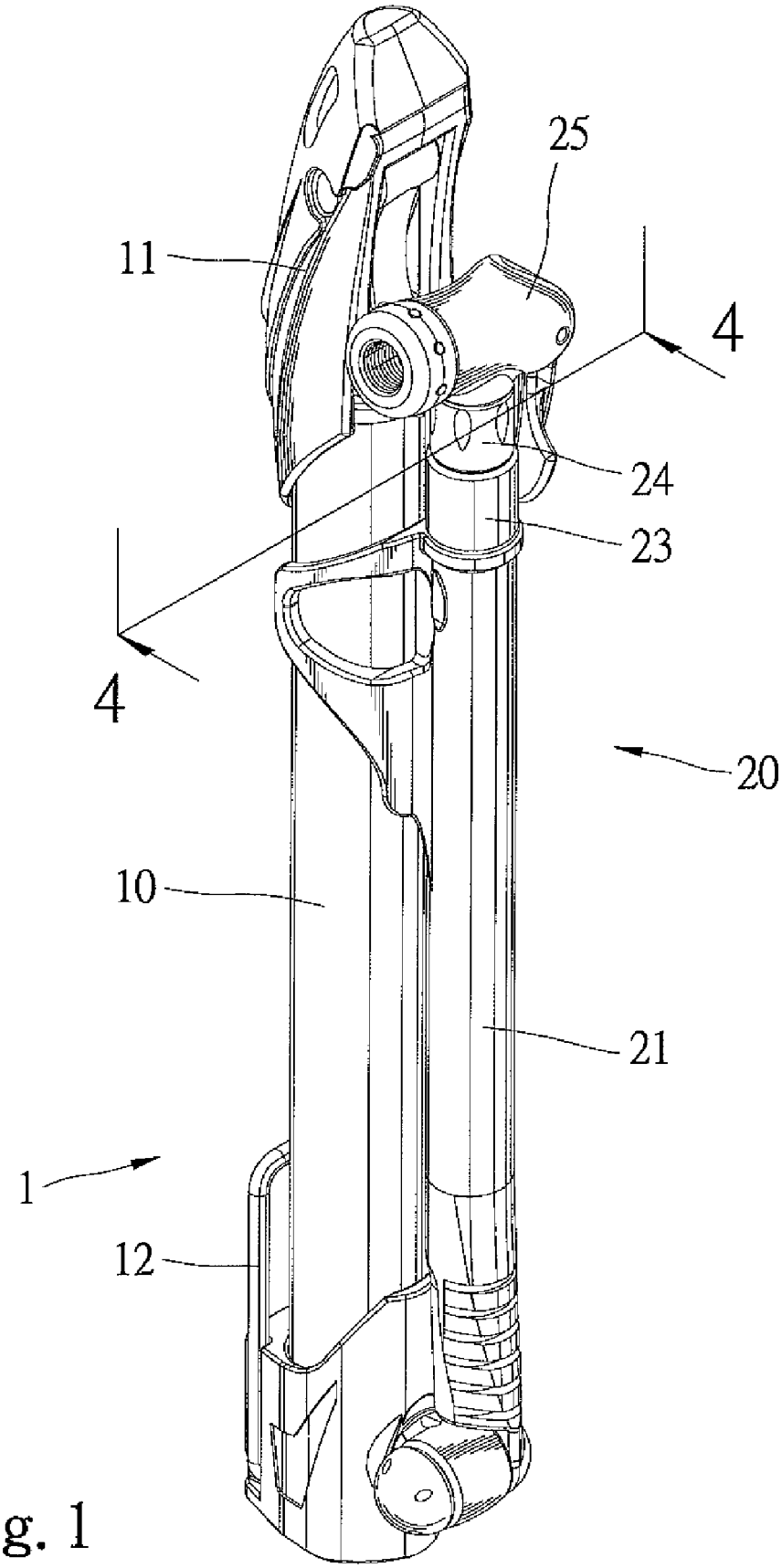
FIG. 1 shows a perspective view of a frame floor pump with an extendable pump unit according to the preferred embodiment of the present invention, illustrating the pump unit collapsed with the frame floor pump.
Figure 2:
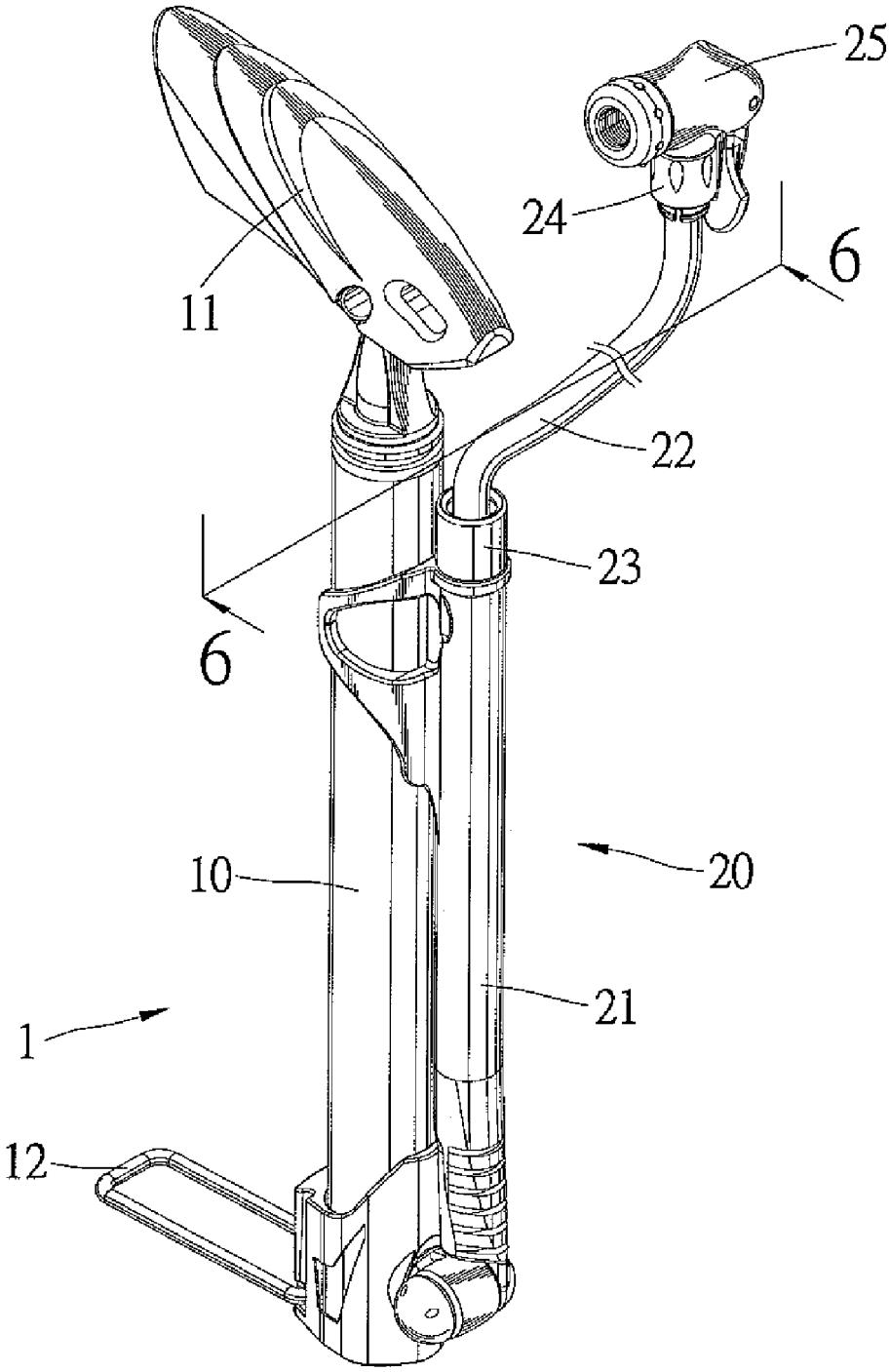
FIG. 2 shows another perspective view of the frame floor pump with the extendable pump unit according to the preferred embodiment of the present invention, illustrating operating the pump unit.
Figure 3:
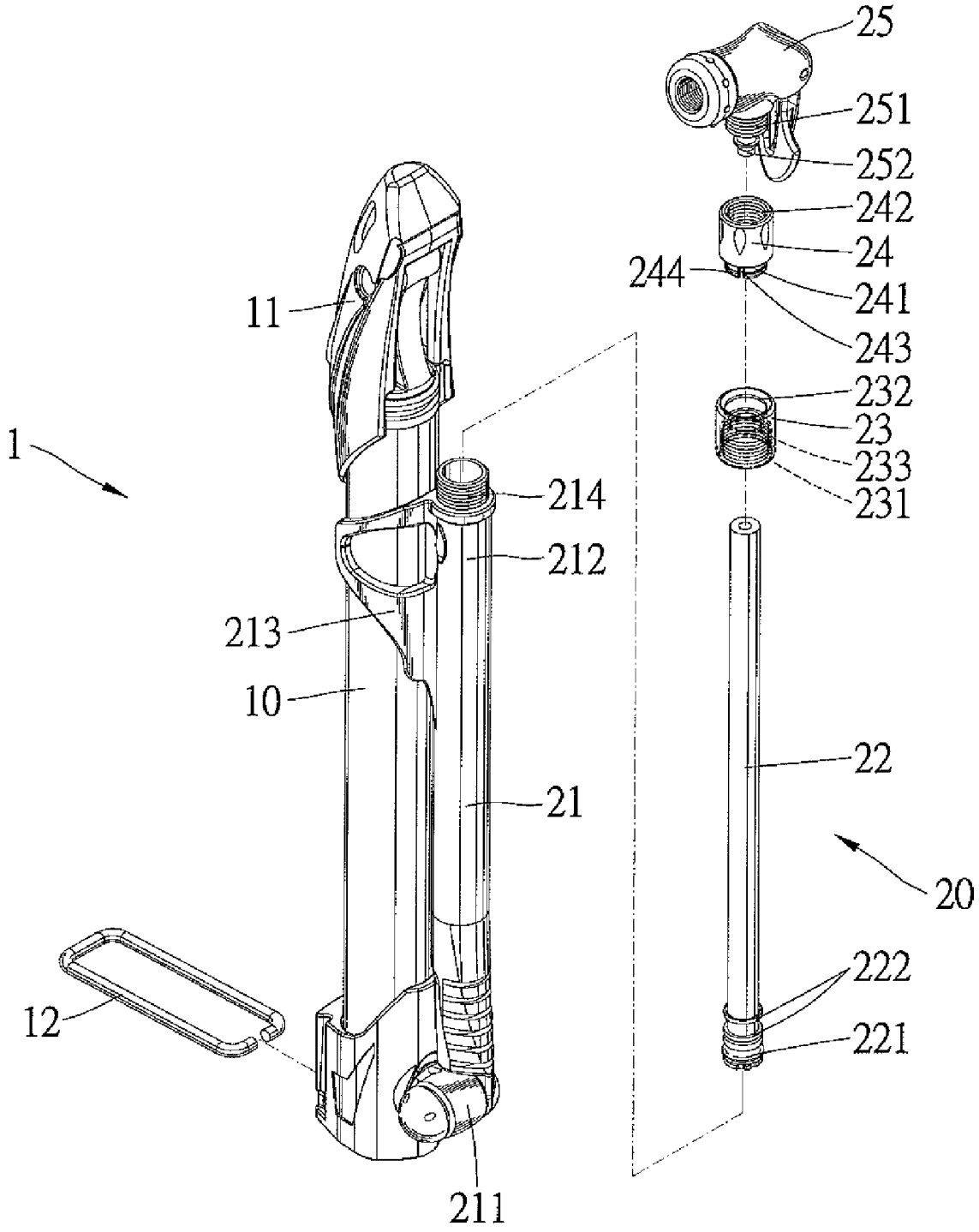
FIG. 3 shows an exploded view of the frame floor pump with the extendable pump unit according to the preferred embodiment of the present invention, illustrating the pump unit collapsed with the frame floor pump.

A frame floor pump according to the preferred embodiment of the present invention is shown in the drawings and includes a cylinder 10 with a first end coupling to a handle device 11, with a second end having a pedal 12 installed on a side thereof and an extendable pipe unit 20 pivotally disposed on another side thereof opposite to the pedal 12. Thus, a user could hold the handle device 11 and open the collapsed pedal 12 to step thereon, while operating the frame floor pump. Furthermore, the extendable pipe unit 20 could be adjusted to various lengths according as the desire of the user.

The extendable pipe unit 20 further includes an outer pipe 21 having a first end 211 disposed pivotally on the second end of the cylinder 10, a second end 212 opposite to the first end 211, a pair of ears 213 formed on a side of the second end 212 and wedging the cylinder 10 for keeping the outer pipe 21 on the cylinder 10 therein and a coupling portion 214 formed on the second end 212. The coupling portion 214 is exterior threads in section.

The extendable pipe unit 20 further includes an inner hose 22 having a piston 221 disposed on an end thereof and a plurality of airtight elements 222 mounted on the periphery of the inner hose 22 around the piston 221. The inner hose 22 is received in the outer pipe 21.

A retaining device 23 is installed on the outer pipe 21 and includes a connecting end 231, which has interior threads, formed in the interior of an end thereof and adapted for engaging with the coupling portion 214 of the outer pipe 21, a retaining portion 232 defined on another end thereof opposite to the connecting end 231 and a blocking portion 233 defined between the connecting end 231 and the retaining portion 232. The blocking portion 233 blocks against the rim (not numbered) of the outer pipe 21 while the connecting end 231 engages with the coupling portion 214 of the outer pipe 21.

A joint 24 is disposed on the retaining device 23 and includes a fixed portion 241 defined on an end thereof and coupling to the retaining portion 232 of the retaining device 23 and an engaging end 242 formed in the interior of another end thereof opposite to the fixed portion 241. The fixed portion 241 forms a plurality of lugs 244 axially thereon and a slot 243 defined between each two of the lugs 244 longitudinally. So that the fixed portion 241 would be flexible.

A nozzle 25 couples to the joint 24 and includes an engaging portion 251 with exterior threads engaging with the engaging end 242 of the joint 24 and an insert end 252 extending from the engaging portion 251 longitudinally and inserting through the joint 24 to the inner hose 22.

Figure 4:
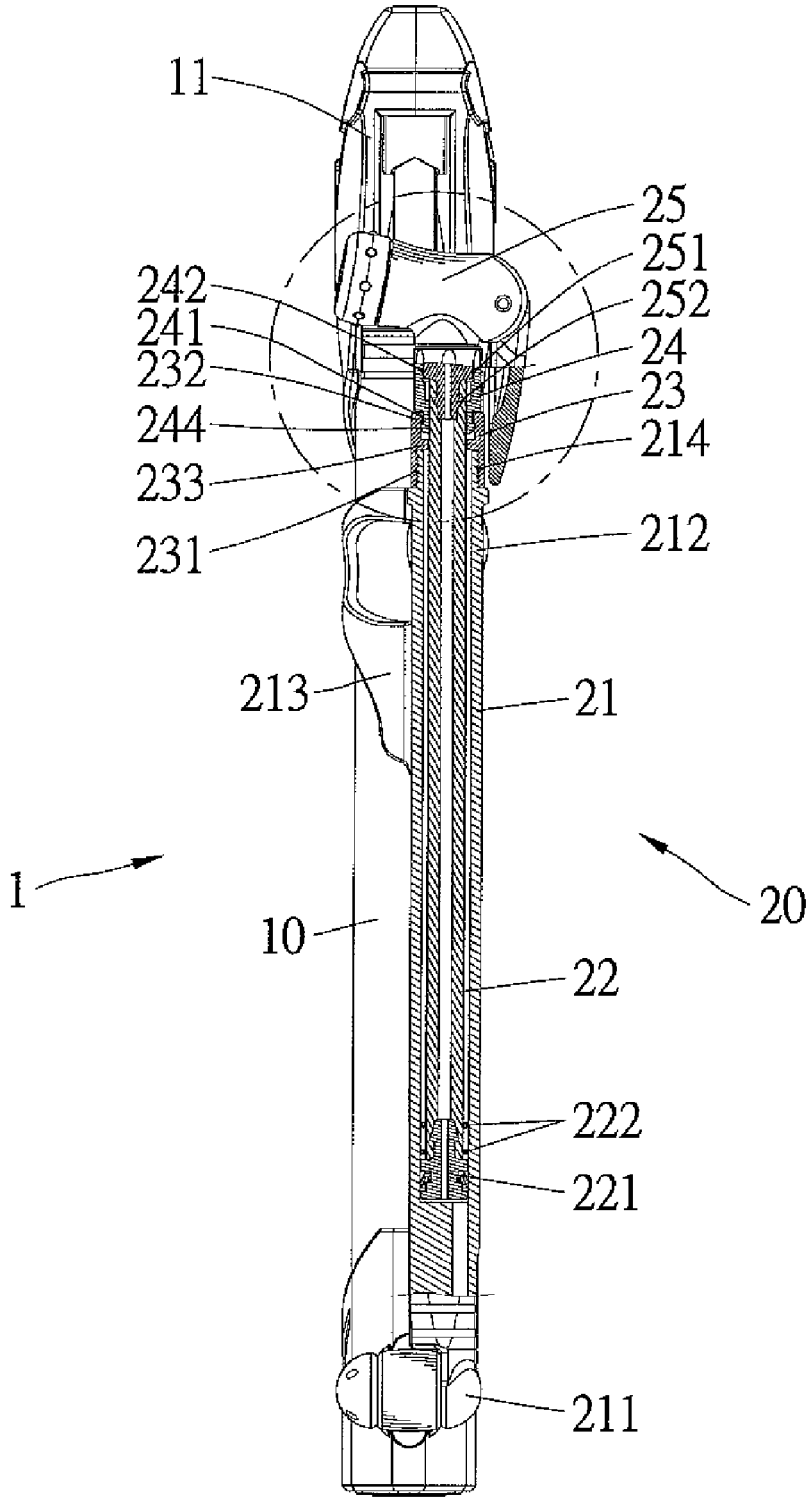
FIG. 4 a cross-sectional view taken along 4-4 in FIG. 1, illustrating the inner hose received in the outer pipe.
Figure 5:
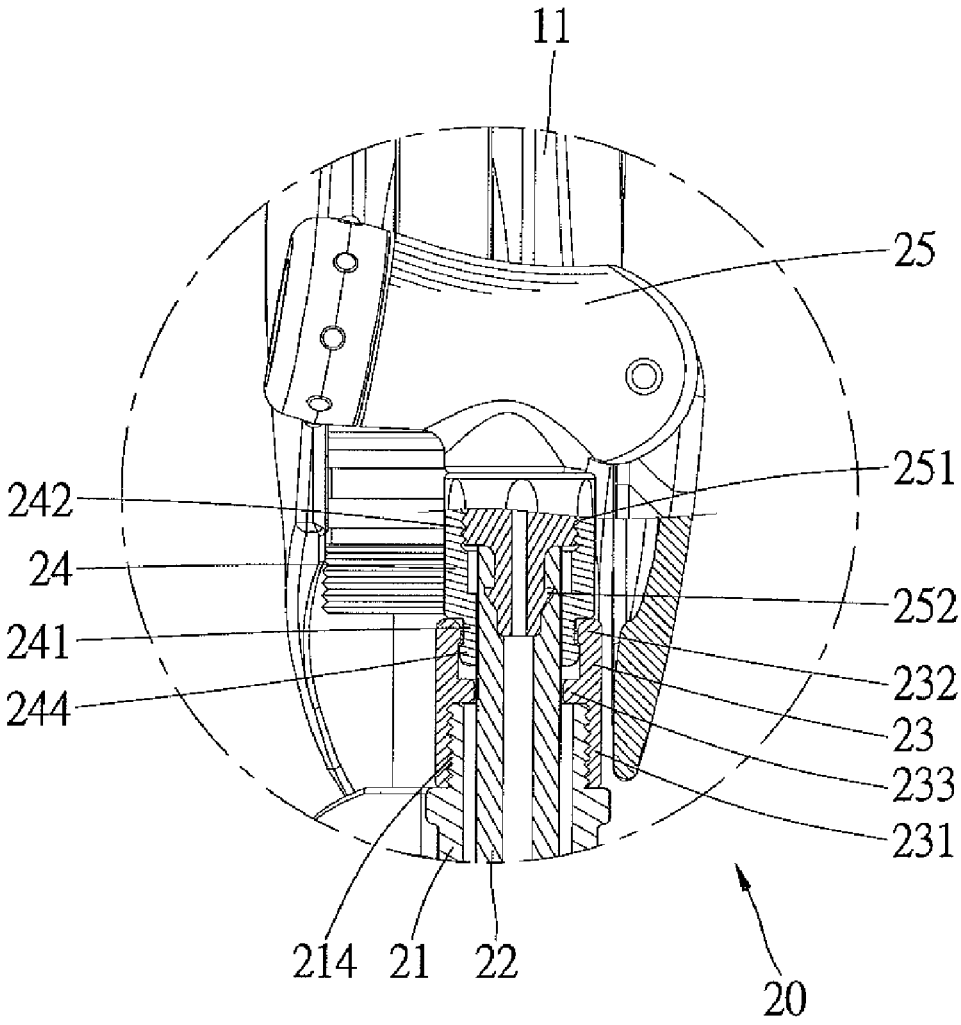
FIG. 5 is an enlarged detailed sectional view taken in FIG. 4, illustrating the joint disposed on the retaining device.

Referring to FIGS. 4 to 5, the inner hose 22 of the extendable pipe unit 20 is received in the outer pipe 21 of the extendable pipe unit 20. The piston 221 is disposed between the inner hose 22 and the outer pipe 21 and provided for sealing so that air could not leak from the interspace between the inner hose 22 and the outer pipe 21. The nozzle 25 is set on the retaining device 23 by coupling to the joint 24.

The fixed portion 241 of the joint 24 is flexible via the alternative arrangement of the lugs 244 and the slots 243 so that the fixed portion 241 could be disposed in the retaining portion 232 of the retaining device 23 quickly and not easy to come off the retaining device 23.

The insert end 252 of the nozzle 25 inserts into the inner hose 22 directly. And the material of the inner hose 22 is provided with flexibility so that the insert end 252 and the inner hose 22 would couple to each other closely. Thus, air could not leak from the connection of the insert end 252 and the inner hose 22 and the insert end 252 of the nozzle 25 would not easy to come off.

Figure 6:
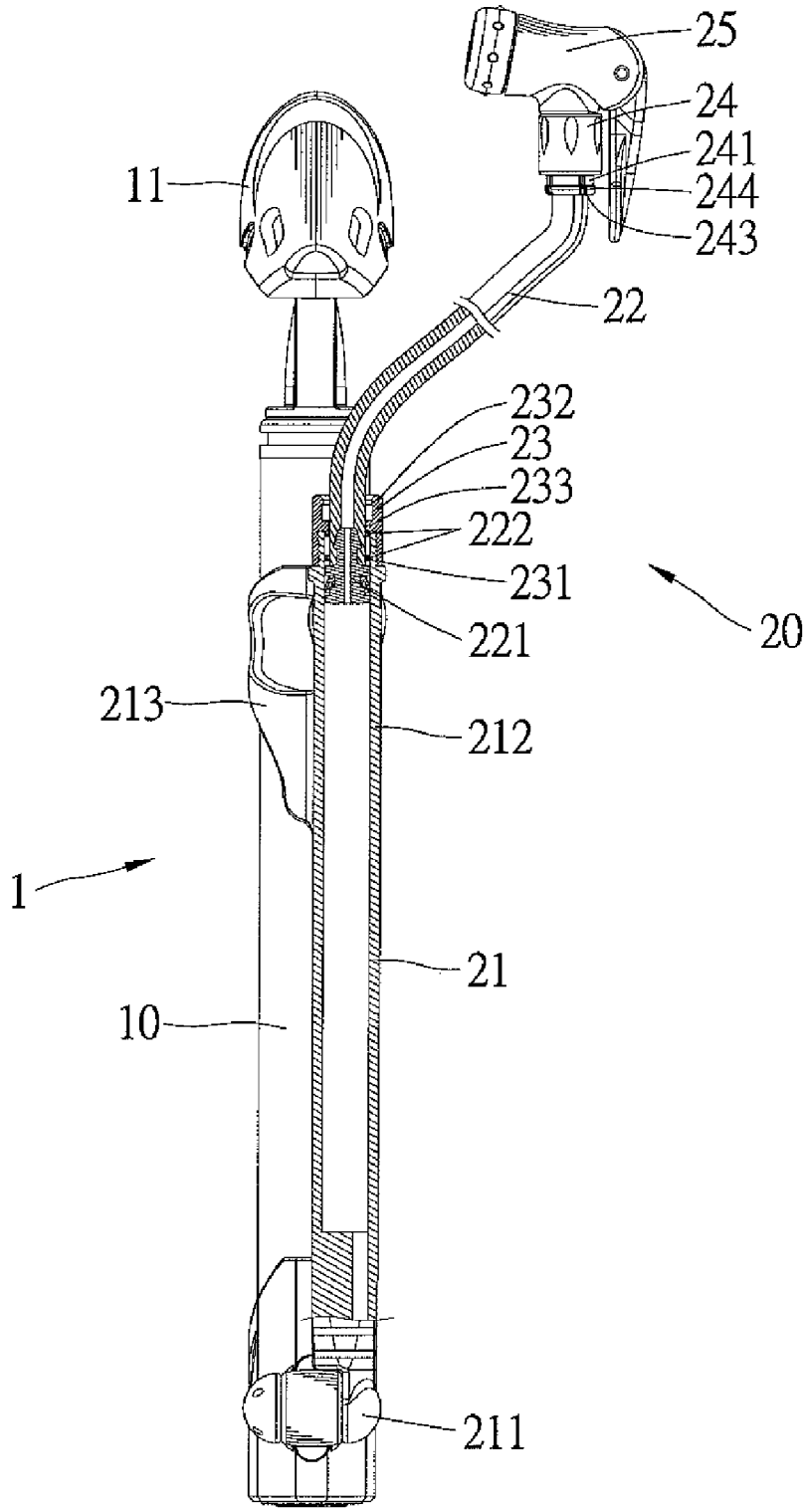
FIG. 6 a cross-sectional view taken along 6-6 in FIG. 2, illustrating the inner hose stretched out from the outer pipe.

Referring to FIG. 6, while the inner hose 22 extends to the limit, the airtight elements 222 of the inner hose 22 are exactly blocked from the blocking portion 233 of the retaining device 23. Therefore, the inner hose 22 would not be disengaged from the outer pipe 21 and air would not leak from the extendable pipe unit 20.

Figure 7:
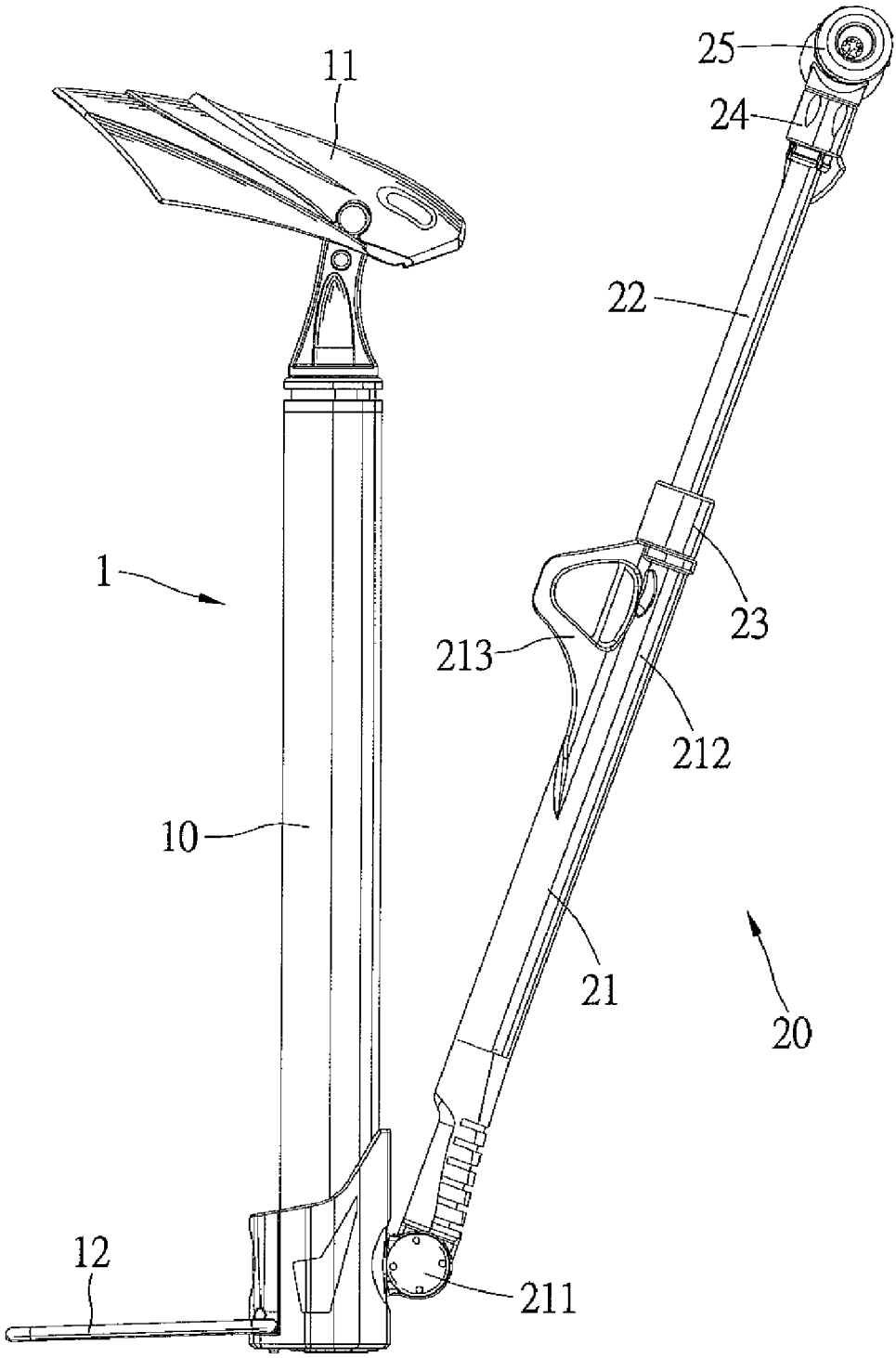
FIG. 7 illustrates the extendable pipe unit could pivot relative to the cylinder according to the preferred embodiment of the present invention.

Referring to FIG. 7, the ears 213 of the outer pipe 21 is disengaged from the cylinder 10 and the extendable pipe unit 20 could pivot relative to the cylinder 10 while a user operates the frame floor pump. Then, the first end 211 of the outer pipe 21 could pivot to various positions and the inner hose 22 would be stretched out from the outer pipe 21 for inflating. Therefore, the user could stay away from a bike and be easy to force to inflate a tire of bike.

The frame floor pump according to the preferred embodiment of the present invention allows easy and quick operation without troublesome grouping encountered with the prior art frame floor pumps. The length of the extendable pipe unit 20 is adjustable and while the frame floor pump is operated, the inner hose 22 of the extendable pipe unit 20 could extend according as the desire of the user; while the frame floor pump is collapsed, the inner hose 22 of the extendable pipe unit 20 could be received in the outer pipe 21 and shrink to the shortest length for easily stowing. The nozzle 25 could be firmly disposed on the retaining device 23 of the extendable pipe unit 20 via the engagement of the joint 24 and the nozzle 25. And the insert end 252 of the nozzle 25 connects to the inner hose 22 directly, thus, the nozzle 25 would not be disengaged from the retaining device 23.

Thus since the invention disclosed herein may be embodied in other specific forms with out departing from the spirit or general characteristics thereof some of which forms have been indicated, the embodiments described herein are to be considered in all respects illustrative and not restrictive. The scope of the invention is to be indicated by the appended claims, rather than by the foregoing description, and all changes which come with the meaning and range of equivalency of the claims are intended to be embraced therein.

What is claimed is:

1. A frame floor pump comprising:

a cylinder including a first end and a second end opposite to the first end;

an extendable pump unit including an outer pipe having a first end installed to a side of the second end of the cylinder and a second end, an inner hose disposed through the second end of the outer pipe and received in the outer pipe and a nozzle provided to couple to an end of the inner hose against the second end of the outer pipe;

wherein the inner hose of the extendable pipe unit could extend to various lengths from the outer pipe of the extendable pipe unit while operating the frame floor pump; while the frame floor pump is collapsed and not used, the inner hose could be received in the outer pipe so as to be easy to stow.

2. The frame floor pump as claimed in claim 1, with the extendable pump unit including a retaining device mounted on the second end of the outer pipe and a joint engaging with an end of the nozzle, where the nozzle coupling to the inner hose, and adapted to install on the retaining device.

3. The frame floor pump as claimed in claim 2, with the retaining device including a connecting end defined an end thereof, with the second end of the outer pipe including a coupling portion adapted for engaging with the connecting end of the retaining device.

4. The frame floor pump as claimed in claim 2, with the nozzle including an engaging portion longitudinally formed toward the joint, with the joint including an engaging end against the nozzle and receiving the engaging portion of the nozzle therein.

5. The frame floor pump as claimed in claim 2, with the retaining device defining a retaining portion against the joint, with the joint forming a fixed portion adapted for disposed in the retaining portion of the retaining device.

6. The frame floor pump as claimed in claim 5, with the fixed portion defining a plurality lugs formed therefrom axially and a slot defined between each two of the lugs;

wherein the lugs and the slots allow the fixed portion being provided with flexibility.

7. The frame floor pump as claimed in claim 6, with the lugs disposed in the retaining portion of the retaining device.

8. The frame floor pump as claimed in claim 2, with the retaining device including a blocking portion therein between the connecting end and the retaining portion, with the inner hose including an airtight element disposed on the outer periphery thereof and exactly blocking against the blocking portion.

9. The frame floor pump as claimed in claim 1, with the second end of the outer pipe including a pair of ears formed on the periphery of the side thereof about the cylinder and wedging to the cylinder for allowing the outer pipe keeping on the cylinder.

10. The frame floor pump as claimed in claim 1, with the second end of the cylinder including a collapsible pedal installed on another side thereof opposite to the extendable pipe unit.

11. The frame floor pump as claimed in claim 1, with the cylinder including a collapsible handle device disposed on the first end thereof.

* * * * *